United States Patent [19]

van Loon et al.

[11] 4,144,472

[45] Mar. 13, 1979

[54] GLOW DISCHARGE LAMP

[75] Inventors: Hermanus van Loon; Henricus G. A. Willems, both of Terneuzen, Netherlands

[73] Assignee: U.S. Philips Corporation, New York, N.Y.

[21] Appl. No.: 911,457

[22] Filed: Jun. 1, 1978

[30] Foreign Application Priority Data

Jun. 2, 1977 [NL] Netherlands ..... 7706037

[51] Int. Cl.[2] ..... H01J 61/06

[52] U.S. Cl. ..... 313/217; 313/210; 313/214

[58] Field of Search ..... 313/217, 210, 214

[56] References Cited

FOREIGN PATENT DOCUMENTS 674565 10/1929 France.

*Primary Examiner*—Palmer C. Demeo

*Assistant Examiner*—Darwin R. Hostetter

*Attorney, Agent, or Firm*—Robert S. Smith

[57] ABSTRACT

A glow discharge lamp provided with two electrode wires, one end of each wire having a feedthrough connection extending through the lamp wall and the other end being embedded in the wall. By shaping the wires as U's and defining certain dimensional relationships, the so-called "hollow cathode" effect is obtained; so reducing the wall-blackening effect with age and enabling the discharge current (and hence the luminous flux) to be increased.

1 Claim, 1 Drawing Figure

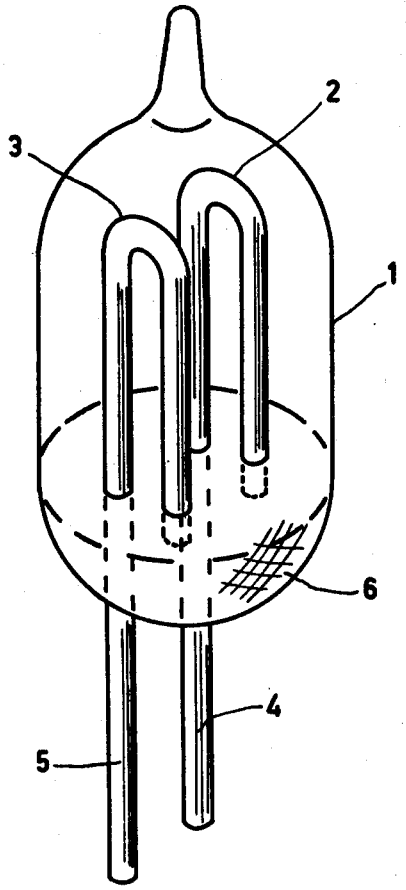
2
3
1
6
4
5

GLOW DISCHARGE LAMP

The invention relates to a glow discharge lamp having a discharge space containing a rare gas and two substantially identical filamentary internal electrodes; only one end of each electrode having a respective feedthrough connection, the other end being embedded in the wall endosing the discharge space.

A prior art glow discharge lamp of the type mentioned is, for example, disclosed in French Patent Specification No. 674,565. A drawback of that known lamp is that the electrodes have a complicated shape, involving interwound helices.

It is an object of the invention to provide, for a glow discharge lamp of the type mentioned in the preamble, a solution in which the electrodes are of a simple shape and, furthermore, the lamp can carry a relatively high electric current and, hence, generate a comparatively high luminous flux.

The invention accordingly provides a glow discharge lamp having a discharge space containing a rare gas and two substantially identical filamentary internal electrodes, only one end of each electrode having a respective feedthrough connection, the other end being embedded in the wall enclosing the discharge space, characterized in that the electrodes are U-shaped, the control plane in which the U of one U-shaped electrode is located being substantially parallel to the corresponding plane in which the other U-shaped electrode is located, and in that imaginary lines connecting corresponding points of the two electrodes are substantially perpendicular to the planes of these electrodes, the spacing A between the two legs of one and the same electrode being smaller than 2½ mm and the spacing B between the two planes exceeding the leg spacing A and furthermore being smaller than 5 mm.

An advantage of this glow discharge lamp is that the electrodes have a simple shape. In addition, this lamp can be loaded more highly because the electrodes are arranged so that an effect is obtained which is comparable to the so-called "hollow cathode" effect. Blackening of the bulb of this lamp hardly occurs.

The effect aimed at is obtained here by the special arrangement of the two U-shaped electrodes. Therein the planes in which the U-shaped electrodes are located are substantially parallel to one another and the leg spacing of each of the electrodes is limited to a certain value, the same as, for example, the spacing between the two peaks of the U's of the electrodes. In case the spacing between the planes exceeds the indicated spacing, as well as in the case of too small a spacing of the peaks of the U's of the electrodes, and with an excessive leg spacing, the desired effect is not obtained.

An embodiment of the invention will now be further explained with reference to the accompanying drawing, which shows a perspective view of a glow discharge lamp according to the invention.

In this drawing reference 1 is a wall enclosing a discharge space.

References 2 and 3 indicate U-shaped electrodes in the discharge space. The electrodes 2 and 3 are arranged symmetrically opposite to one another. The plane through the U of one electrode is substantially parallel to the corresponding plane through the other electrode. References 4 and 5 denote supply leads of these electrodes 2 and 3. The ends of the electrodes 2 and 3 which are not electrically connected to a supply lead are embedded in an end seal 6 of the lamp.

The wall consists of glass and the leads, as well as the electrodes consist of nickel-plated copper-clad wire. Furthermore, the discharge space contains a filling gas which consists substantially entirely of neon at a pressure of approximately 100 Torr. The leg spacing of the U's of each electrode is approximately one mm. The spacing between the control panel containing the U of one electrode and the corresponding plane of the other electrode is approximately 1.3 mm. The overall length of the lamp is approximately 13 mm and the diameter approximately 5 mm. This lamp can be loaded with a current of approximately 0.7 mA. The voltage between the electrodes 2 and 3 is approximately 170 volts. The lumen value of this lamp is approximately twice that of a glow discharge lamp, not according to the invention, the construction of which is identical to that of the described lamp except that one end of each of the electrodes 2 and 3 is in the discharge space, that is to say not embedded in the seal 6.

At the above-mentioned current strength of 0.7 mA, the lamp according to the invention showed substantially no blackening, even after 4500 operating hours.

What is claimed is:

1. A glow discharge lamp having an envelope and a discharge space therein containing a rare gas and two substantially identical filamentary internal electrodes, only one end of each electrode having a respective feedthrough connection, the other end being embedded in said envelope enclosing the discharge space, characterized in that the electrodes are U-shaped, the control plane in which the U of one U-shaped electrode is located being substantially parallel to the corresponding plane in which the other U-shaped electrode is located, and in that imaginary lines connecting corresponding points of the two electrodes are substantially perpendicular to the planes of these electrodes, the spacing between the two legs of each electrode being smaller than 2½ mm, and the spacing between the two planes exceeding the leg spacing and being furthermore smaller than 5 mm.

* * * * *